US007510343B1

(12) United States Patent
Arrington et al.

(10) Patent No.: US 7,510,343 B1
(45) Date of Patent: Mar. 31, 2009

(54) METHOD OF RETRACTING A TEAR BAR IN A PRINTER

(75) Inventors: Stacy L. Arrington, Raleigh, NC (US); Richard H. Harris, Raleigh, NC (US); Dean F. Herring, Youngsville, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/131,979

(22) Filed: Jun. 3, 2008

(51) Int. Cl.
*B41J 11/70* (2006.01)

(52) U.S. Cl. ..... 400/621; 400/693

(58) Field of Classification Search ..... None
See application file for complete search history.

(56) References Cited

U.S. PATENT DOCUMENTS

| | | | | |
|---|---|---|---|---|
| 3,991,923 A | | 11/1976 | Nishikawa | |
| 4,907,014 A | * | 3/1990 | Tzeng et al. | 346/24 |
| 6,443,645 B1 | * | 9/2002 | Takei et al. | 400/621 |
| 7,362,346 B2 | | 4/2008 | Watanabe et al. | |
| 2005/0123336 A1 | * | 6/2005 | Oshida et al. | 400/621 |
| 2008/0095564 A1 | * | 4/2008 | Yada et al. | 400/613 |

FOREIGN PATENT DOCUMENTS

| | | | |
|---|---|---|---|
| JP | 01111609 A | * | 4/1989 |
| JP | 02078352 U | * | 6/1990 |
| JP | 05147285 A | * | 6/1993 |
| JP | 2000052291 A | * | 2/2000 |

OTHER PUBLICATIONS

Translation of JP 02078352 U to Sugai Jun. 1990.*

* cited by examiner

*Primary Examiner*—Daniel J Colilla
(74) *Attorney, Agent, or Firm*—Cantor Colburn LLP; Jason Piche

(57) ABSTRACT

A method of retracting a tear bar in a printer includes pivoting a printer access cover away from a printer housing to expose a paper storage portion, and retracting a tear bar into the printer housing away from the paper storage portion through operation of pivoting the printer access cover.

1 Claim, 3 Drawing Sheets

METHOD OF RETRACTING A TEAR BAR IN A PRINTER

BACKGROUND OF THE INVENTION

1. Field of the Invention

This invention relates to the art of printers and, more particularly, to a method of retracting a tear bar in a printer.

2. Description of Background

Many retail establishments employ printers to print customer receipts. The printer is connected to a checkout terminal and includes a continuous roll of paper that is consumed over time. During a transaction, the printer prints, for example, a list of items purchased and corresponding prices on the paper. Ultimately, a total is printed, and a consumer or cashier draws the paper against a tear bar to remove a printed receipt. When the roll is empty, a new roll must be loaded into the printer before additional receipts are printed. In either case, the tear bar can hamper removing and replacing the roll. In some cases, the tear bar is mounted in a printer housing directly adjacent a paper loading area and may impede paper loading. In other cases, the tear bar is mounted in a printer cover. Cover mounted tear bars hamper sliding and end portion of the roll of paper through a slot formed in the printer cover.

SUMMARY OF THE INVENTION

The shortcomings of the prior art are overcome and additional advantages are provided through the provision of a method of retracting a tear bar in a printer. The method includes pivoting a printer access cover away from a printer housing to expose a paper storage portion, and retracting a tear bar into the printer housing away from the paper storage portion through operation of pivoting the printer access cover.

Additional features and advantages are realized through the techniques of exemplary embodiments of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the exemplary embodiments of the invention, together with advantages and features, by way of example with reference to the drawings.

DETAILED DESCRIPTION OF THE INVENTION

Figure 1:
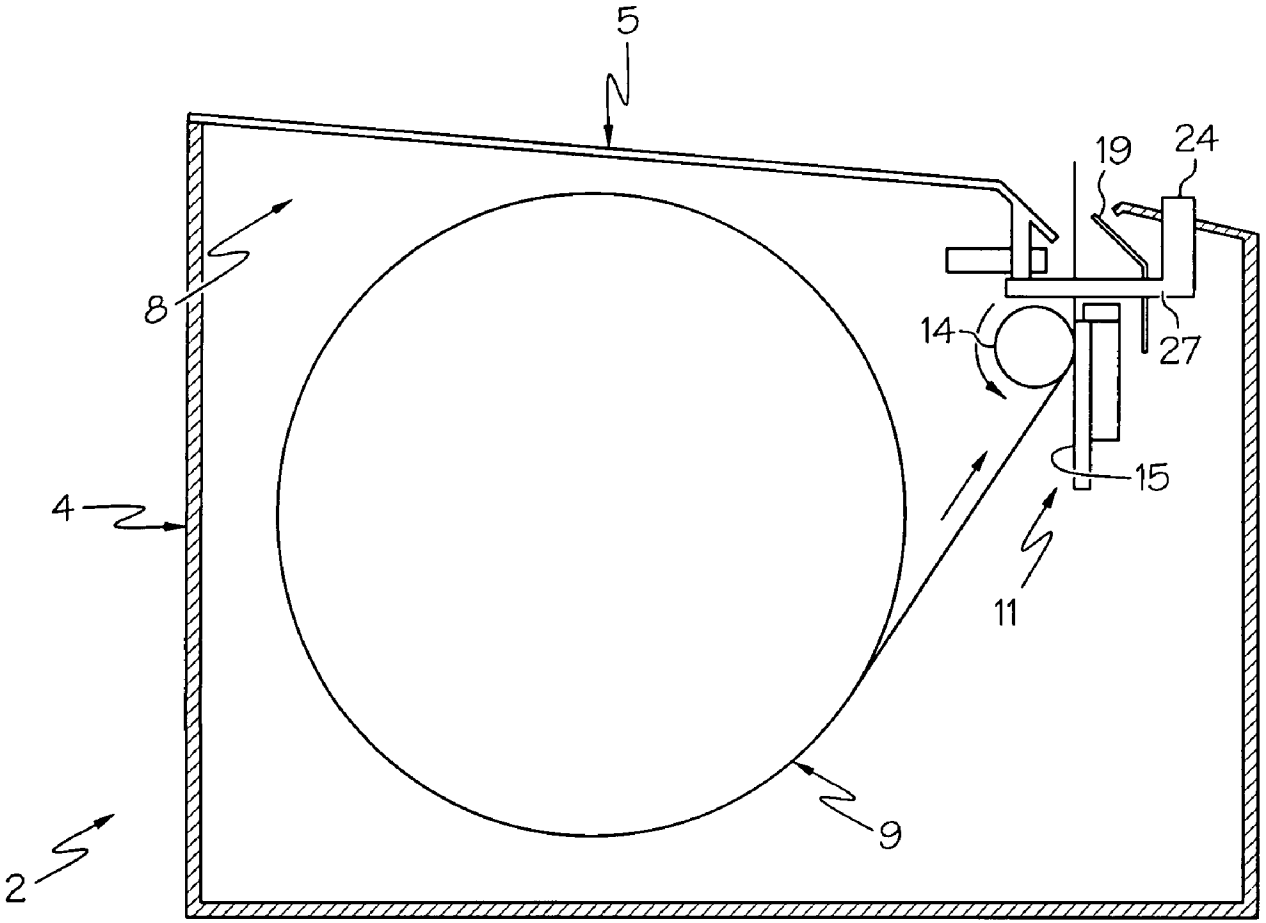
FIG. 1 is a cross-sectional side view of a point of sale (POS) printer having a retracting tear bar in accordance with exemplary embodiments of the invention illustrating the retractable tear bar in a first or operational position.

With initial reference to FIG. 1, a point-of-sale printer constructed in accordance with exemplary embodiments of the invention is indicated generally at 2. Printer 2 includes a housing 4 having a cover 5. Cover 5 is pivotally mounted to housing 4 so as to expose a paper storage portion 8. As shown, paper storage portion 8 houses a roll of paper 9 as well as printing system 11 including, a platen 14 and a print head 15. Of course, it should be understood that printing system 11 includes additional components/systems that are not shown for sake of simplicity of the figures.

Figure 2:
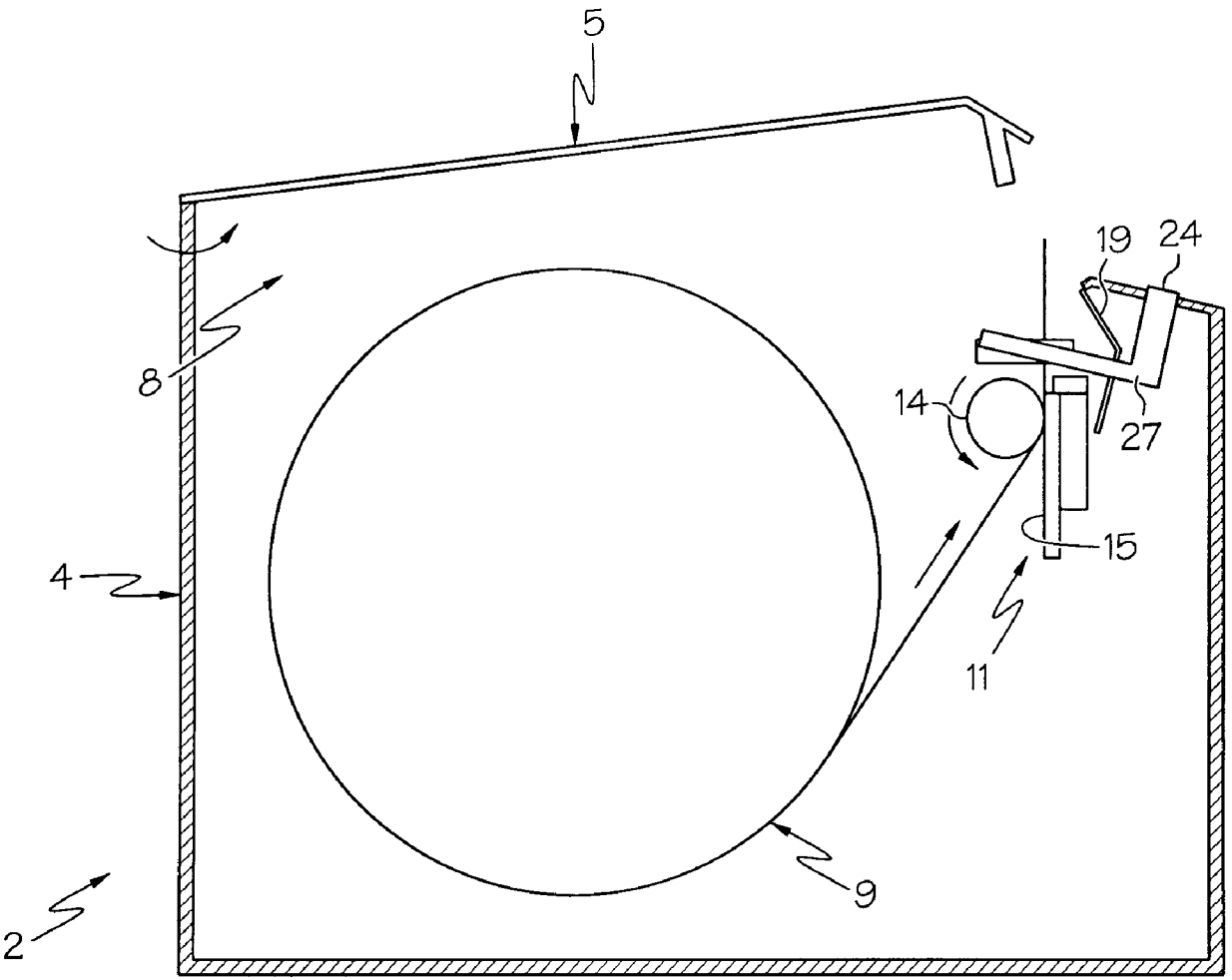
FIG. 2 is a cross-sectional side view of the point of sale (POS) printer of FIG. 1 illustrating the retractable tear bar in a second or retracted position.

In accordance with the exemplary embodiment shown, printer 2 includes a retractable tear bar 19. Retractable tear bar 19 is operatively connected to a cover release member 24 via a linkage 27. In operation, cover release member 24 is activated to release cover 5. More specifically, upon activating cover release member 24, cover 5 pivots open to expose paper storage portion 8. At the same time, linkage 27 shifts tear bar 19 from a first or operating position illustrated in FIG. 1 to a second, or service position with tear bar 19 being retracted, such as illustrated in FIG. 2. In accordance with one aspect of the exemplary embodiment, tear bar 19 is retracted or pivoted by creating a mass imbalance. That is, cover release member 24 acts upon linkage 27 so as to create a mass imbalance that causes tear bar 19 to pivot or shift to the service position, encased completely within housing 4.

Figure 3:
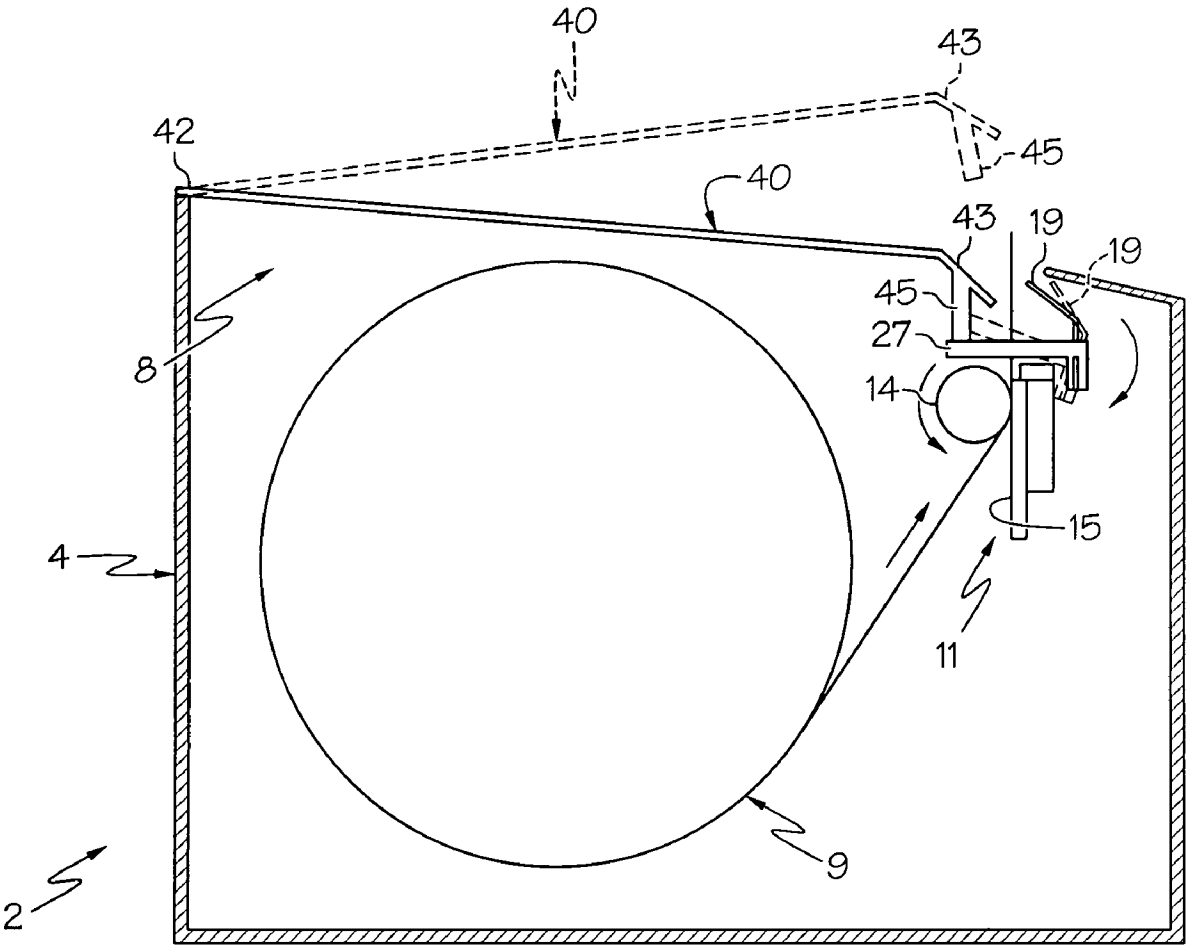
FIG. 3 is a cross-sectional side view of a point of sale (POS) printer having a retracting tear bar in accordance with another exemplary embodiment of the invention.

In accordance with another aspect of the invention illustrated in FIG. 3, wherein like reference numbers represent corresponding parts in the respective views, printer 2 is formed without a cover release member. In this construction, a cover 40 includes a first end portion 42 pivotally mounted to housing 4 that extends to a second end portion 43 having a tear bar activator 45. When cover 40 is closed, tear bar activator 45 engages linkage 27 causing tear bar 19 to shift to the first or operation position. When cover 40 is opened, tear bar activator 45 disengages from linkages 27 creating a mass imbalance that results in tear bar 19 shifting to the second or service position, retracting into housing 4. That is, once cover 40 is opened, tear bar 19 pivots to the service position and is completely encased within housing 4.

With this construction, paper is readily passed between platen 14 and print head 15 and passed by tear bar 19 in a retracted configuration. By retracting tear bar 19 into paper storage portion 8 and away from exposed areas, not only is loading paper made easier, but overall serviceability of printer 2 is enhanced. Of course it should be realized that various other systems can be employed to retract tear bar 19 into housing 4. For example, a linkage (not shown) connected operatively connected to cover 5 and acting upon tear bar 19 could also be employed without departing from the spirit of exemplary embodiments of the invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

The invention claimed is:

1. A method of retracting a tear bar in a printer comprising:

activating a cover release member operatively connected to a tear bar and a printer access cover;

pivoting the printer access cover from a printer housing to expose a paper storage portion; and retracting the tear bar into the printer housing away from a service position and the paper storage portion through operation of the cover release member and a mass imbalance.

* * * * *